United States Patent [19]

Bittel et al.

[11] Patent Number: 4,895,492

[45] Date of Patent: Jan. 23, 1990

[54] DOUBLE ACTING AND AUTOMATICALLY REVERSING PRESSURE INTENSIFIER

[75] Inventors: Karl Bittel; Rudi Bardoux, both of Leipzig, German Democratic Rep.

[73] Assignee: VEB Kombinat ORSTA-Hydraulik, Leipzig, German Democratic Rep.

[21] Appl. No.: 809,284

[22] Filed: Dec. 16, 1985

Related U.S. Application Data

[63] Continuation-in-part of Ser. No. 534,158, Sep. 21, 1983, abandoned, and Ser. No. 742,620, Jun. 7, 1985, Pat. No. 4,735,051.

[30] Foreign Application Priority Data

Sep. 27, 1982 [DD] German Democratic Rep. ..... 2435027

[51] Int. Cl.[4] ..... F15B 3/00

[52] U.S. Cl. ..... 417/225; 417/400; 91/290; 91/319

[58] Field of Search ..... 91/290, 319, 281, 397; 60/537, 547.1, 593; 417/225, 400, 523

[56] References Cited

U.S. PATENT DOCUMENTS

| | | | |
|---|---|---|---|
| 2,652,780 | 9/1953 | Adams | 417/400 |
| 3,186,169 | 6/1965 | Hauser | 91/290 |
| 3,713,755 | 1/1973 | Scheffer | 417/469 |
| 3,776,665 | 12/1973 | Dalton | 417/252 X |
| 3,780,621 | 12/1973 | Romell | 91/290 |
| 4,212,597 | 7/1980 | Galimallofre | 91/319 |
| 4,281,587 | 8/1981 | Garcia-Crespo | 91/290 |
| 4,397,614 | 8/1983 | Larner | 417/403 |
| 4,523,895 | 6/1985 | Silva | 417/225 |
| 4,735,051 | 4/1988 | Bittel et al. | 91/290 X |

FOREIGN PATENT DOCUMENTS

| | | | |
|---|---|---|---|
| 1903852 | 8/1972 | Fed. Rep. of Germany . | |
| 2245866 | 4/1975 | France . | |
| 623014 | 9/1978 | U.S.S.R. . | |
| 2159890 | 12/1985 | United Kingdom | 417/225 |

OTHER PUBLICATIONS

Bittel, Dr. Ing. "High Pressure Flow Generation," in *Power International,* Oct. 1986, pp. 279–281.

*Primary Examiner*—Robert E. Garrett
*Assistant Examiner*—George Kapsalas
*Attorney, Agent, or Firm*—Horst M. Kasper

[57] ABSTRACT

A double acting and at the limit positions automatically reversing pressure intensifier. A case has a first bore hole and a second bore hole. A pressure intensifier piston slides in the first bore hole of the case and subdivides the first bore hole into two low pressure work spaces and is furnished with two flat control grooves at the outer circumference and with two cylindrical bore holes. Two high pressure pistons are solidly mounted to the case for sliding relative to and inside of the two cylindrical bore holes of the pressure intensifier piston. A check valve is disposed in the pressure intensifier piston and connects the two bore holes. A control slider is disposed in the case and furnished with two flat control grooves about at its middle region which connect to respective front faces of the slider via cross bore holes and axial bore holes in the control slider. A wide bypass groove is disposed on the outside of the control slider. A feed bore is disposed in the case and a discharge bore is disposed in the case. Each of a pair of bypass grooves in the second bore hole are connected to the feed bore. Each of a pair of bypass grooves in the second bore hole are connected to the discharge bore. Another pair of bypass grooves are connected each to a low pressure work volume of the first bore hole.

14 Claims, 4 Drawing Sheets

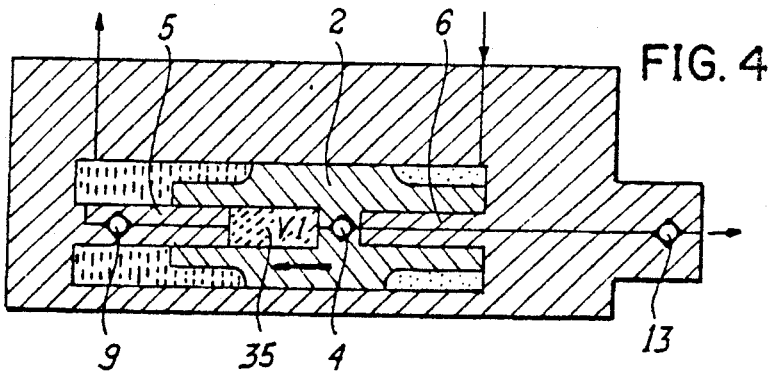
FIG. 4
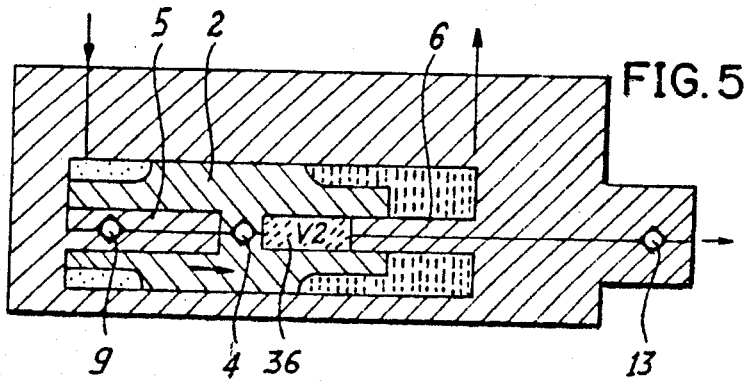
FIG. 5
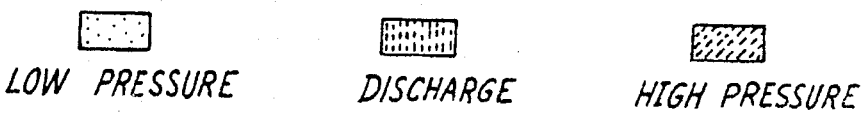

DOUBLE ACTING AND AUTOMATICALLY REVERSING PRESSURE INTENSIFIER

CROSS-REFERENCE TO RELATED APPLICATIONS

This is a continuation-in-part application of prior application Ser. No. 06/534,158 filed Sept. 21, 1983 and now abandoned. The application is also a continuation-in-part of prior application Ser. No. 06/742,620 filed June 7, 1985 and now issued as U.S. Pat. No. 4,735,051 dated Apr. 5, 1988.

BACKGROUND OF THE INVENTION

1. Field of the Invention

The present invention relates to a double acting pressure intensifier or pressure booster with a pressure intensifier piston, which is automatically reversed in its limit positions.

2. Brief Description of the Prior Art

The pressure intensifier piston of known double acting pressure boosters is provided as a disk piston pressurized with the primary pressure and furnished with two thinner high pressure pistons disposed symmetrically relative to the middle plane. The disk piston together with the bore hole in which it slides forms two low pressure work volumes, which are alternatingly subjected to the low pressure power providing fluid. A directional control valve controls the low pressure oil stream and the directional control valve is actuated by pilot valves or by control switch valves. The low pressure part practically operates as a linear hydraulic motor while the two high pressure parts operate as a valve controlled pump. The disadvantage of these pressure intensifiers includes the expenditure required for the control members and the relatively large span of time required for switching the pressure intensifier piston and the pressure drop caused by the procedure.

Pressure intensifiers switching at their end positions have been constructed in order to eliminate the disadvantages of these pressure converters, where a control shell is disposed surrounding the pressure intensifier piston and controlling the feed and discharge. According to such an arrangement the control shell is shifted with stops of the pressure intensifier piston while approaching its end position and thus the driving force of the pressure intensifier piston is controlled. Since the mechanical control of the control shell despite corresponding auxiliary measures does not result in a stable switching at the end positions, a hydraulic control arrangement was constructed. In this construction the ring surfaces of two shoulders at the outer diameter of the control shell are alternatingly connected to the pressure feed or discharge side depending on the position of the pressure intensifier piston. The setting adjustment motion of the control shell is always provided against the direction of motion of the pressure intensifier piston. The cut control bores are rapidly and completely released by the opposite motion to the pressure intensifier piston, whereby the control shell is reliably moved in the other position such that a stable switching of the direction of motion of the pressure intensifier piston is assured under any condition, for example in cases where a small or a large transport flow or, respectively, pressure is present. The assured switching of the pressure intensifier piston is therefore tied to a geometrical coordination of the pressure intensifier piston to the control shell and this appears to be possible only if pressure intensifier piston and control shell contact each other or, respectively, if the pressure intensifier piston is surrounded by the control shell.

This coaxial coordination of the pressure intensifier piston and of the control shell, in particular in cases where the latter is surrounded by three additional control bushings, is disadvantageous regarding production requirements. Small deviations from a coaxial arrangement result in a clamping and sticking of the control shell in cases where the interspaces are to be kept small in order to reduce leakage losses.

SUMMARY OF THE INVENTION

1. Purposes of the Invention

It is an object of the present invention to exclude the influences of minor deviations of coaxiality from the operational efficiency of the pressure intensifier.

If is a further object of the present invention to reduce the length of the pressure intensifier while maintaining the size of the stroke of the pressure intensifier piston.

It is another object of the present invention to provide a control device for the direction of motion of a pressure intensifier piston, which is relatively independent from machining tolerances and relative displacements of the component parts and which allows to construct hydraulic apparatus with low space requirements.

These and other objects and advantages of the present invention will become evident from the description which follows.

2. Brief Description of the Invention

The present invention provides according to one aspect a double acting and at the limit positions automatically reversing pressure intensifier which comprises a case having a first bore hole and a second bore hole, a pressure intensifier piston sliding in the first bore hole of the case, subdividing the first bore hole into two low pressure work spaces and furnished with two flat control grooves at the outer circumference and with two cylindrical bore holes, two high pressure pistons solidly mounted to the case for sliding relative to and inside of the two cylindrical bore holes of the pressure intensifier piston, a check valve disposed in the pressure intensifier piston and connecting the two bore holes, a control slider disposed in the case and furnished with two flat control grooves about at its middle region connected to respective front faces of the slider via cross bore holes and axial bore holes in the control slider, two wide bypass grooves disposed on the outside of the control slider, a feed bore disposed in the case, a discharge bore disposed in the case, a pair of bypass grooves in the second bore hole each connected to the feed bore, a pair of bypass grooves in the second bore hole each connected to the discharge bore, and a pair of bypass grooves each connected to a low pressure work space of the first bore hole.

The pressure intensifier piston can have flat grooves at its outer circumference. The cross-sections of the high pressure pistons can be about 2:1 for the piston on the input side to the piston on the high pressure output side. The control slider can be provided with two flat control grooves, which are connected to the front faces of the control slider via cross-bores and two axial bores. The control slider can be provided on each of its two end sides with a wide and deep bypass groove. The control slider can run in parallel to the pressure intensifier piston and the feed bore in the case can run in parallel to the control slider direction of motion for input of working fluid into the system and the discharge bore in the case can run in parallel to the control slider direction of motion for discharging working fluid after use.

The pair of bypass grooves each connected to the discharge groove can be disposed near the ends of the second bore. The pair of bypass grooves each connected to the feed bore can be disposed more toward the center of the second bore hole. The pair of bypass grooves each connected to a low pressure work space can be disposed between the pair of bypass grooves each connected to the discharge bore and the pair of bypass grooves each connected to the feed bore.

A control bore can connect the middle of the first bore for the pressure intensifier piston to the feed bore. Two control bores, disposed at a distance from the control bores connecting to the feed bore, can connect the discharge bore to the first bore for the pressure intensifier piston. Two closely spaced control bores on each of the two sides relative to the middle connect the bore of the pressure intensifier piston to the bore for the control slider.

The pressure intensifier piston can be provided with flat control grooves of which the ones disposed toward the middle are wider than the outer control grooves and which control grooves are disposed such that in the limit position of the pressure intensifier piston on the right (left) side the outer left (right) flat control groove connects at least one of the two closely spaced left (right) control bores to the control groove on the left (right) side connected to the discharge bore, while the inner left (right) flat control groove connects the control bore connected to the feed bore to the two closely spaced right (left) control bores.

The width of the web between the two control grooves of the control slider can be dimensioned such that in the right (left) limit position of the control slider the right (left) inner control bore of the closely spaced control bores is covered by the web and, respectively, only the right (left) outer control bore of the closely spaced control bores is freely connected.

Two collars can be disposed at the ends of the control slider having a diameter smaller than the diameter of the middle piece resulting in that the outer shoulders of the bypass grooves of the control slider are more flat than the inner shoulders such that a force imbalance results after pressure being exerted in one of the bypass grooves of the control slider acting on the control slider in the direction of the other bypass groove of the control slider.

Two bushings can be slid into the bore hole having cylindrical shape for the control slider for providing a sliding seal between the case and the outer collars of the control slider and having radial bores at a location corresponding to the bypass groove connected to the discharge bore and to the bypass groove connected to the first bore hole.

According to another aspect of the invention there is provided a double acting and at the limiting positions automatic reversing pressure intensifier which comprises a case having a first and a second bore hole, a pressure intensifier piston sliding in the first bore hole, stationary pistons engaging the pressure intensifier piston to generate a higher pressure in the fluid, means disposed at the pressure intensifier piston to provide two different flow connections at the two limiting positions of the pressure intensifier piston, a control slider disposed in the second bore hole, hydraulic means connected to the means disposed at the pressure intensifier piston to provide two different flow connections for moving the control slider from one limiting position into the opposite limiting position when the pressure intensifier reaches each of its limiting positions; hydraulic valve means associated with the control slider to supply pressure fluid to move the pressure intensifier piston while the control slider is in limiting position.

According to one embodiment of the invention, a control slider is disposed separately and parallel to the pressure intensifier piston and is provided with two flat control grooves in the middle region. The control grooves are connected to the front faces of the control slider via cross bores with two separate axial bores. Furthermore, the control slider is provided at the two outer ends with a wide and deep bypass groove. Bore holes for the feed and for the discharge line are disposed on the two sides and parallel to the bore hole for the control slider. The bore hole for the control slider is provided on the two sides with three deeper bypass grooves, of which the two outer ones are connected to the discharge line and the inner ones are connected to the feed line. The middle bypass grooves are connected to the low pressure work areas of the pressure intensifier piston and cylinder via corresponding bore holes. The bore hole for the pressure intensifier piston is connected to the feed line in the middle via a control bore and is connected on the side further at a certain distance to the discharge bore via a control bore each. Two closely spaced bore holes are somewhat staggered relative to the side and are disposed in between and they connect the bore hole of the control slider with the bore hole of the pressure intensifier piston.

It is a further feature of the invention that the pressure intensifier piston is provided with two inner somewhat wider, flat and with two outer, somewhat narrower control grooves, which release the mentioned control bore holes or, respectively, cover the bore holes by having, for example while the pressure intensifier piston is in the right limiting position, the left outer control groove of the pressure intensifier piston prevent the discharge with the left control groove of the control slider via corresponding control bores. At the same time, the left inner control groove of the pressure intensifier piston connects the right control groove of the control slider to the feed line.

A further feature comprises that the two closely spaced control bores are disposed such that for example the inner one of the two right neighboring control bores is covered by the edge of the control slider in the right position of the control slider and vice versa.

According to one feature of the present invention, the diameter of two collars at the ends of the control slide is less than the diameter of the middle piece such that the inner shoulders of the bypass grooves are higher than the outer ones, where the mounting of the control slider is rendered possible by way of two bushings.

According to a further aspect of the invention there is provided a method for intensifying the pressure of a fluid which comprises feeding hydraulic fluid to a first bore hole in a case at a desired prepressure and to a second bore hole at a working pressure in a case, disposing in the first bore hole a pressure intensifier piston having a cylindrical bore hole for surrounding the stationary cylinder, providing hydraulic work fluid to the case, switching the hydraulic work fluid flow lines with a control slider disposed in the second bore hole of the case for driving the pressure intensifier piston to apply pressure to a high pressure medium, and feeding hydraulic work fluid via a control groove in the circumference of the pressure intensifier piston to move the control slider from one limiting position to the other when the pressure intensifier piston reaches a limiting position.

The motion of the control slider can be controlled by a flow of hydraulic work fluid from a feed bore via a bore in the case via a groove in the circumference of the pressure intensifier piston via another bore in the case via a bore in the control slider into the area in front of the control slider end surface experiencing the driving force and by a flow of hydraulic work fluid from the end surface of the control slider disposed in the direction of motion of the control slider via a bore in the control slider via a bore in the case via a groove in the circumference of the pressure intensifier piston via a bore in the case to a discharge bore. The pressure intensifier piston can be driven with hydraulic fluid coming from a feed bore disposed in the case running via a bore in the case to a bypass groove in the control slider via a bore in the case to one low pressure work space of the first bore hole providing the driving force of the pressure intensifier piston and running hydraulic fluid from the second low pressure work space of the first bore via a bore disposed in the case to a bypass groove in the control slider via a further bore in the case to a discharge bore in the case.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments and features of the present invention:

FIG. 4 is a schematic sectional view of a pressure intensifier piston in its right end position, FIG. 5 is a schematic sectional view of the pressure intensifier piston in its left end position.

DESCRIPTION OF INVENTION AND PREFERRED EMBODIMENTS

Figure 1:
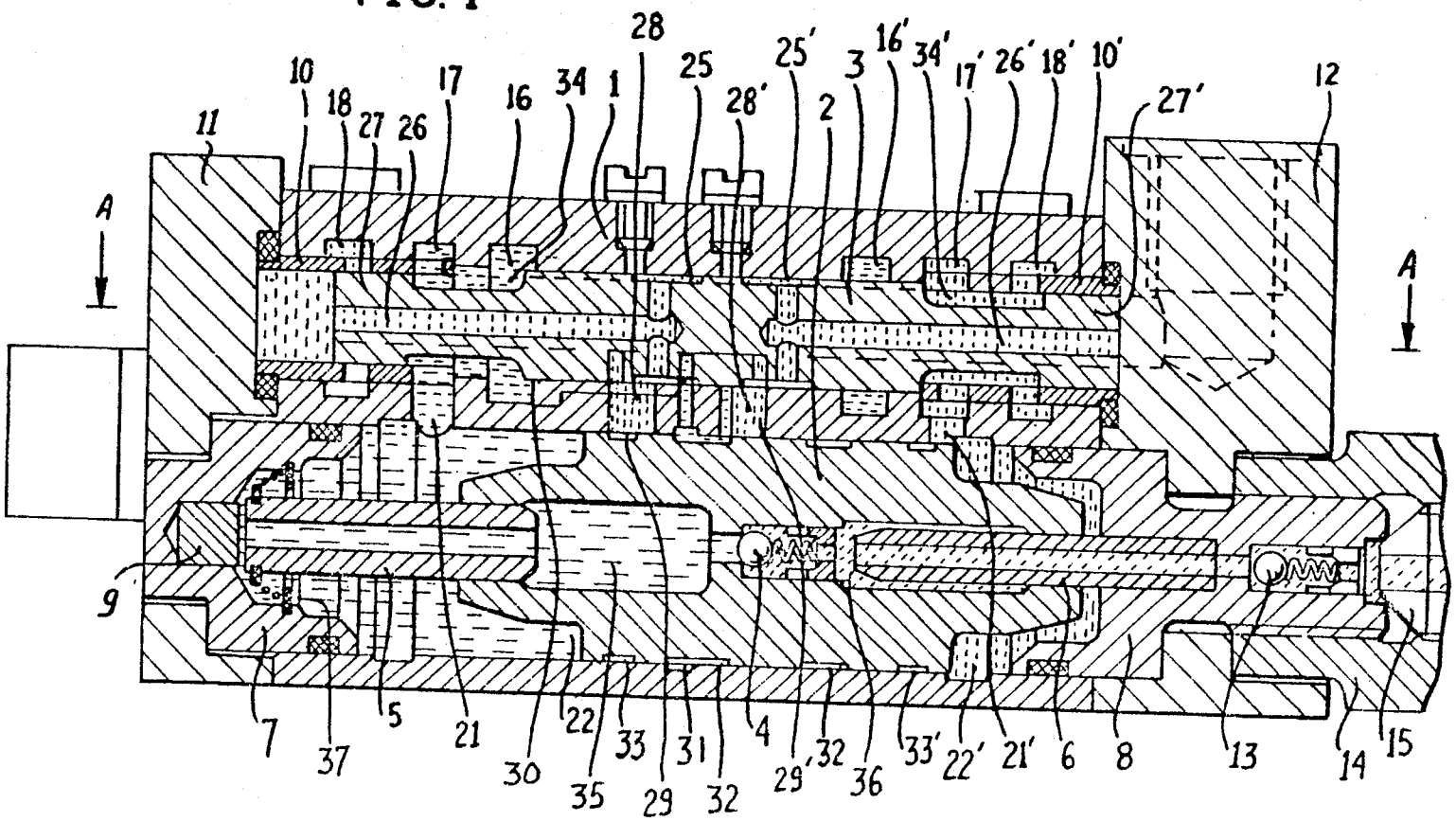
FIG. 1 is an axial sectional view through a pressure intensifier device according to the present invention.

In accordance with the present invention there is provided a double acting and at the limiting positions automatically reversing pressure intensifier, which includes a case 1 wherein a pressure intensifier piston 2 slides. The pressure intensifier piston 2 is provided at its outer circumference with flat control grooves and it separates the bore hole in which it slides into two low pressure work spaces 2, 22' and it is provided with two cylindrical bores. The pressure intensifier piston 2 and two high pressure pistons 5, 6 having cross-sections with a ratio of 2:1 form two high pressure work spaces 35, 36 which are connected with each other via a check valve 4 opening toward the smaller high pressure work space 36.

A control slide 3 is disposed in the case 1 in parallel to the pressure intensifier piston 2. The control slider 3 is provided in its middle region with two flat control grooves 25, 25', which join the front faces of the control slide 3 via cross bores and two axial bores 26, 26'. A wide and deep bypass groove 34, 34' is provided on the two sides of the control slide 3. On the one hand a feed bore hole 24 and on the other hand a discharge bore 20 are disposed in parallel to the bore hole in which the control slider 3 moves. The bore hole for the control slider 3 is provided on each side with three bypass grooves 16, 17, 18; 16', 17', 18' of which the two outer bypass grooves 18, 18' are connected to the discharge bore hole 20 via in each case a bore hole 19, 19'. The two inner bypass grooves 16, 16' are connected to the feed bore hole 24 by way of a bore hole line 23, 23' each and the middle bypass grooves 17, 17' are connected by way of two bore holes 21, 21' to the low pressure work spaces 22, 22' of the pressure intensifier piston 2 and case 1.

The bore hole for the pressure intensifier piston 2 can be connected in the middle to the feed bore hole 24 via a control bore 30 and at a lateral distance to the discharge bore 20 via two control bore holes 29, 29'. In each case two closely spaced control bore holes 28, 28' are disposed on the two sides between these control bore holes 29, 29', 30, which connect the bore hole of the pressure intensifier piston 2 to the bore hole of the control slider 3.

The pressure intensifier piston 2 can comprise flat control grooves 32, 33; 32', 33', of which the inner control grooves 32, 32' are somewhat wider than the outer control grooves 33, 33'. Preferably, the width of the inner groove is from about 1.5 to 5 times the width of the corresponding outer groove. The grooves can be disposed such that the outer left (right) control groove 33 connects at least one of the two closely spaced left (right) control bores 28 to the left (right) control bore 29 running to the discharge bore hole 20 while the pressure intensifier piston 2 is in the right (left) limit position. On the other hand the inner left (right) control groove 32 connects the control bore 30 connected to the feed bore hole 24 to the two closely spaced right (left) control bores 28'.

The width of the web or bridge between the two control grooves 25, 25' of the control slide 3 are dimensioned such that the right (left) inner control bore hole 28' of the closely spaced control bores 28, 28' is covered by the web while the control slider 3 is in the right (left) limiting position or, respectively, only the right (left) outer control bore 28' is free.

The diameter of two collars 27, 27' disposed at the ends of the control slider 3 can be smaller than that of the middle piece. Thus the outer shoulders of the bypass grooves 34, 34' of the control slider 3 can be more flat than the inner shoulders such that upon pressure in one of the bypass grooves 34, 34' a resulting forces is produced acting on the control slider 3 in the direction of the other bypass groove 34, 34'. Further bushings 10, 10' are slid into the bore hole for the control slider 3 to provide a sealing and sliding seal between the case 1 and the outer collars 27, 27' of the control slide 3. The bushings 10, 10' are furnished with radial bore holes, which have a wall distance which is equal to the width of the web between the bypass grooves 17, 18.

When the control slider 3 of FIG. 1 is in the right end position, then the following connections are in effect:

The bypass groove 16 of the case 1 is connected on the one hand to the bypass groove 34 of the control slider 3. The bypass groove 34 of the control slider 3 is connected to the bypass groove 17 of the case 1. The bypass groove 17 of the case 1 is connected to the bore 21 in the case 1. The bore 21 in the case 21 is connected to the low pressure work space 22 of the pressure intensifier piston 2 as shown in FIG. 1. The bypass groove 16 is connected on the other hand to the bore 23. The bore 23 is connected to the feed bore hole 24 as shown in FIG. 2.

The bypass groove 18 is blocked in the direction of the low pressure work space 22 as illustrated FIG. 1. On the other hand the bypass groove 18 is connected via the bore 19 to the discharge bore 20 as shown in FIG. 2.

Figure 2:
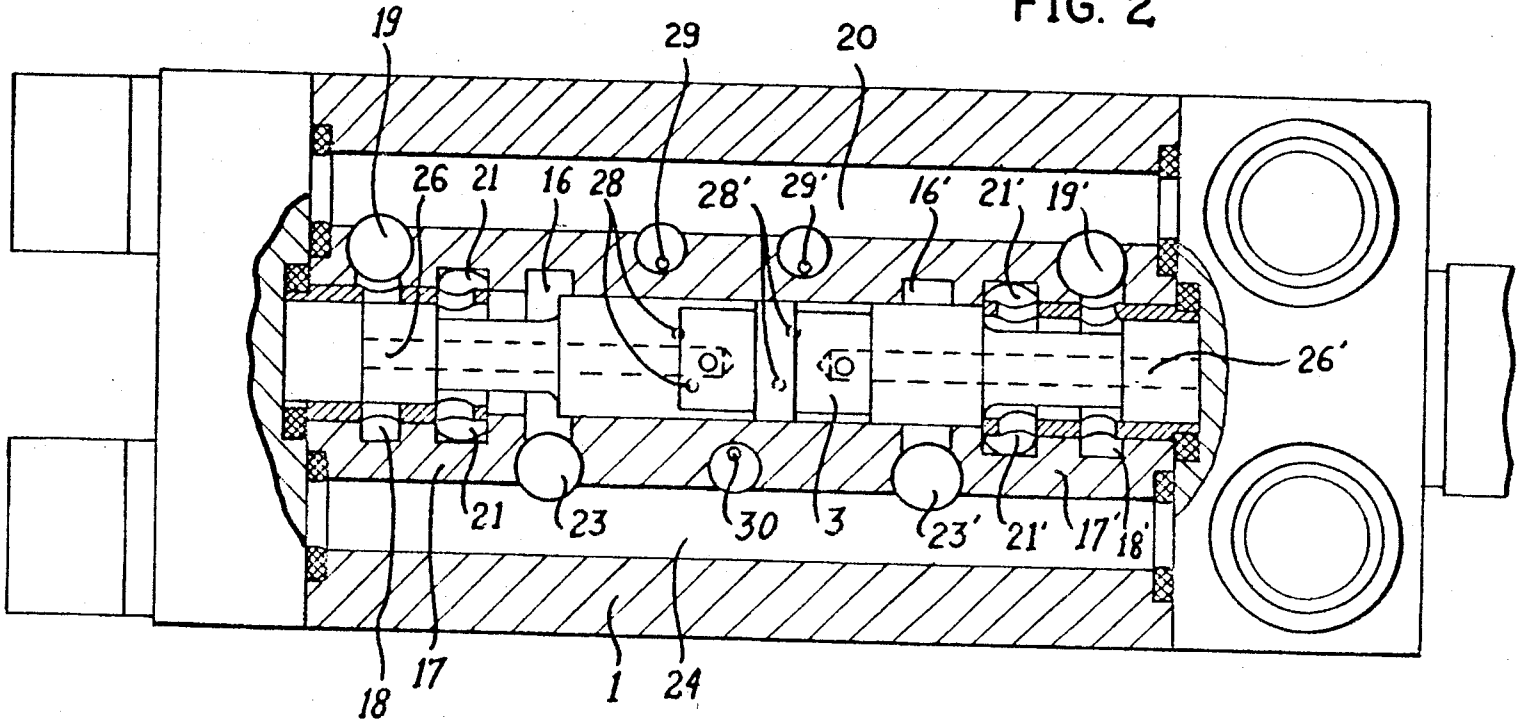
FIG. 2 is a sectional view along section line A—A turned by 90 degrees through the control slider of the pressure intensifier.

The bypass groove 16' is blocked in the direction of the low pressure working space 22' as shown in FIG. 1. 0n the other hand, the bypass groove 16' is connected via bore 23' to the feed bore hole 24 as illustrated in FIG. 2.

The bypass groove 18' is connected on the one hand to the bypass groove 34'. The bypass groove 34' is connected to the bypass groove 17'. The bypass groove 17' is connected to the bore hole 21'. The bore hole 21' is connected to the low pressure work spaces 22' as illustrated in FIG. 1. The bypass groove 18' is on the other hand connected to the bore 19'. The bore 19' is connected to the discharge bore 20 as illustrated in FIG. 2.

Where the control slider is in the left end position, then the following connections are present:

The bypass groove 16 is blocked in the direction of the low pressure work spaces 22. On the other hand the bypass groove 16 is connected via bore hole 23 to the feed bore hole 24.

The bypass groove 18 is connected on the one hand to the wide and deep bypass groove 34. The wide and deep bypass groove 34 is connected to the bypass groove 17. The bypass groove 17 is connected to the bore hole 21. The bore hole 21 is connected to the low pressure work spaces 22. On the other hand the bypass groove 18 is connected via the bore 19 to the discharge bore hole 20.

The bypass groove 16' is connected to the bypass groove 34'. The bypass groove 34' is connected to the bypass groove 17'. The bypass groove 17' is connected to the bore hole 21'. The bore hole 21' is connected to the low pressure work space 22'. On the other hand the bypass groove 16' is connected via bore hole 23' to the feed bore hole 24.

The bypass groove 18' is blocked in the direction of the low pressure work spaces 22'. On the other hand the bypass groove 18' is connected via bore 19' to the discharge bore 20.

Summarizing, in the right end position of the control slider, the low pressure work spaces 22 is connected to the feed bore hole 24 via the bypass groove 16. The low pressure work spaces 22' is connected to the discharge bore 20 via the bypass groove 18'. In the left end position of the control slider 3, the low pressure work spaces 22 is connected to the discharge bore 20 via the bypass groove 18. The low pressure work spaces 22' is connected to the pressure power feed line via the bypass groove 16'.

The pressure intensifier of the present invention provides the advantage that its pressure intensifier piston and cylinder are relatively insensitive to manufacturing tolerances and positional deviations.

The pressure intensifier comprises a case 1 and the pressure intensifier piston 2 is slidably disposed in the larger bore of the case 1 and the control slider 3 is slidably disposed in the above located smaller bore hole. A check valve 4 is disposed in the pressure intensifier piston 2 and the high pressure pistons 5, 6 are slidably disposed at the two front faces. The high pressure piston 5 is supported by a pressure piece 9 disposed at a seal lock 7. The high pressure piston 6 is pressed into a base bore of a seal lock 8. Two short bushings 10, 10' are disposed left and right in the bore hole for the control slider 3. The bushings 10, 10' can be provided at their outer end with a recess for providing a seal. The short bushings 10, 10' are supported by the covers 11, 12 just as the seal 8 are supported. The closing element 8 is drilled through and comprises the discharge valve 13. A high pressure connection 15 can be tightened with a union nut 14.

The bore hole for the control slider 3 is provided symmetrically left and right with three bypass grooves 16, 17, 18, 16', 17', 18'. The outer bypass grooves 18, 18' are connected to a discharge bore 20 via bores 19, 19'. The middle bypass grooves 17, 17' are connected to the low pressure work volumes 22, 22' of the pressure intensifier piston 2 via bore holes 21, 21'. The inner bypass grooves 16, 16' are connected to a pressure power feed bore hole 24 via bore holes 23, 23'. Preferably, the distance of the bypass grooves 16 and 17 from each other is from about 0.8 to 1.25 the distance of the bypass grooves 17 and 18 from each other.

The bypass grooves 16, 16', 18, 18' can be connected to the low pressure work volumes 22, 22' of the pressure intensifier piston 2 depending on the position of the control slide 3. One side is connected to the discharge bore and the other side is connected to the feed bore and vice versa.

The control slider 3 is provided with two flat control grooves 25, 25', which are connected via cross-bore holes to axial bore 26, 26', and with collars 27, 27' at the ends.

Two closely neighboring control bores 28, 28', disposed in pairs, are disposed between the bores for the pressure intensifier piston 2 and the control slider 3 and are connecting them. Again symmetrically with respect to the middle there are disposed two control bores 29, 29' somewhat further outside, which connect the bore hole of the pressure intensifier piston 2 to the discharge bore hole 20. A further control bore 30 disposed in the middle connects the bore hole for the pressure intensifier piston 2, which is provided with a flat, small groove 31 at this position, to the feed bore hole 24. The pressure intensifier piston 2 is also provided with flat control grooves, and in fact with two inner control grooves 32, 32' and with two outer, somewhat narrower control grooves 33, 33'. The control slider 3 is provided at its ends in each case with a wide and deep bypass groove 34, 34'. The outer shoulders of the bypass grooves 34, 34' have a lower height at the collars 27, 27' based on the disposition of the bushings 10, 10' as compared with the inner shoulders. The pressure intensifier piston 2 together with the high pressure piston 5 provides a high pressure work volume 35 and with the high pressure piston 6 a high pressure work volume 36. The high pressure piston 5 is pretensioned the direction of the pressure piece 9 based on the spring 37.

The mode of operation is as follows: The pressure intensifier piston 2 is disposed at its right limiting position shortly before switching direction. The left edge of the right control groove 25' of the control slide 3 still covers the inner one of the two neighboring right control bores 28'. Even though the left inner control groove 32 has released the inner one of the two neighboring control bores 28' to the pressure intensifier piston 2, therewith thus no control oil stream can flow through one of the two neighboring right control bores 28', since the one is closed by the pressure intensifier piston 2 and the other by the control slider 3. Only if the pressure intensifier piston 2 still moves somewhat further to the right side, a control oil stream flows via the outer one of the two neighboring right control bores 28' and further via the right control grooves 25' of the control slider 3 through the cross-bore holes to the right axial bore 26 of the control slider 3, presses against the right front face of the control slider 3 and thus presses the control slider 3 leftward, Thereby the left edge of the right control groove 25' of the control slider 3 releases the inner one of the right neighboring control bores 28' such that also in case of a starting reversal of the motion of the pressure intensifier piston 2 there remains sufficient time for the control slider 3 to reach the right limit position, before the leftward moving pressure intensifier piston 2 closes first the right and then the left of the two neighboring control bores 28. The surface difference between inner higher and outer lower shoulder resulting from the different shoulder height level of the bypass groove 34 effects a safe resting of the control slider 3 in its right limit position. According to the position show in the drawing thus a rightward directed force operates in the left bypass groove 34, which force maintains the control slider in its right limit position.

The movement of the control slider 3 from the right position into the left limit position is only possible, if in addition to the already described feed flow of a control oil stream into the right axial bore 26' it is simultaneously possible to move out the oil disposed between the left cover 11 and the left front face of the control slider 3. This becomes possible since the left outer control groove 33 at the pressure intensifier piston 2 connects the neighboring control bores 28 to the left control bore 29, which runs to the discharge bore 20.

If the pressure intensifier piston 2 moves leftward after this switching then there result intermediate positions, where it connects the neighboring control bores 28, 28' on the one hand to the feed control bore 30 and also to the discharge bore holes 29, 29'. This however does not occurs simultaneously in the middle positions such that no switching of the control slider 3 occurs. The simultaneous release occurs only in the limit positions such that on the one hand the full piston stroke of the pressure intensifier piston 2 and on the other hand its reliable redirection in the limit positions are assured.

Based on the described control of the control slider 3 via the pressure intensifier piston 2, the latter is alternatingly on one side pressed by the feed pressure and is released on the other side by way of the discharge line. According to the Figs. shown, the high pressure piston 5, the left front face of which is at the same time a valve seat, is still lifted up versus the pressure piece 9. Still some pressure oil flows from the left low pressure work volume 22 to the high pressure work area 35. Then the check valve closes. A small amount of high pressure oil is pushed out from the high pressure work volume 36 via the output . valve 13. In case of a reversal of the direction of motion the high pressure piston 5 closes acting as a suction valve. This closing effect is supported further by the spring 37. Oil is pushed from the high pressure work volume 35 via the check valve 4 into the high pressure work volume 36 through the leftward moving pressure intensifier piston 2. Since all cross-sections of the high pressure piston 5, 6 are related like 2:1, their displacement volumes follow the same ratio. Independent if the pressure intensifier piston 2 moves from left to right or vice versa, always the same volume is pushed out via the output valve 13.

Figure 3:
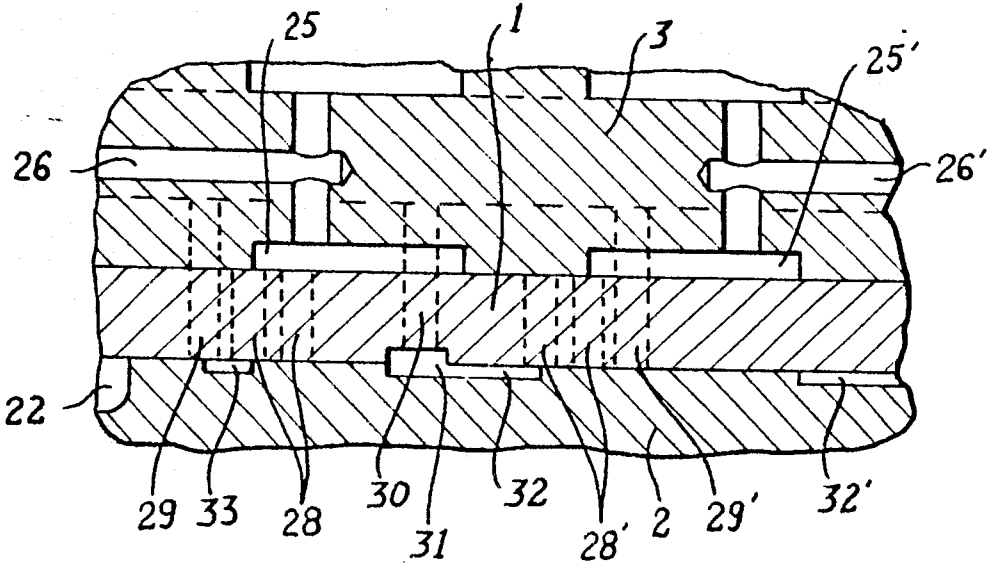
FIG. 3 is a schematic sectional view of a detail in the region of the control bores between the pressure intensifier piston and the control slider according to FIG. 1.

In more detail, reference is now made to FIGS. 1, 2 and 3, and one recognizes the position of the pressure intensifier piston 2 and of the control slider 3, where the control slider 3 is about in its right end position, while the pressure intensifier piston 2 is found in a right hand side position shortly before reversal of direction under the control system.

A low pressure is applied in the left low pressure work volume 22 of the pressure intensifier piston 2 via the pressure power feed bore hole 24 and the bore 23 (FIG. 2), the bypass groove 16, the deep bypass groove 34, the bypass groove 17 and the bore hole 21 (FIG. 1). The relatively low pressure applied to the low pressure work volume is generated by a driver aggregate such as a hydraulic pump external to the pressure booster. The inner one of the two neighboring right control bores 28' has been released already by the left inner control groove 32 at the pressure intensifier piston 2, while the other side of the control bore 28' is still covered by the left edge of the right control groove 25' of the control slider 3. The outer one of the two neighboring right control bores 28' has already been released by the right flat control groove 25', but is still covered by the pressure intensifier piston 2 as illustrated in FIG. 3.

Thus at this point no stream of controlling oil flows through one of the two neighboring right control bores 28'. Only if the pressure intensifier piston 2 still moves somewhat to the right hand side based on the applied low pressure, then a control oil stream flows from the pressure power feed bore hole 24 via the feed control bore 30 the control groove 32, the outer one of the two neighboring right control bores 28', the control groove 25', the cross bores and the right axial bore hole 26', to the right front face of the control slider 3. This control oil stream presses the control slider 3 to the left. The oil disposed at the left front face of the control slider 3 can pass to the discharge bore 20 via the axial bore 26, the cross bores, the control groove 25, the left neighboring control bores 28, the control groove 33 and the control bore 29 to the discharge bore 20.

If the control slider 3 also moves to the left, then the initially described connection between the feed bore hole 24 and the left low pressure work spaces 22 is interrupted by the right edge of the bypass groove 34 of the control slider 3 passing over the left edge of the bypass groove 16. At the same time the bypass groove 34 opens a connection between the bypass groove 17 and the bypass groove 18 such that the left low pressure work space 22 now is connected to the discharge bore 20 via the bore 21, the bypass groove 17, the bypass groove 34, the bypass groove 18 and the bore hole 19. In contrast, on the right hand side the connection of the low pressure work spaces 22' to the discharge bore 20 via the bore 21', the bypass groove 17', the bypass groove 34', the bypass groove 18' and the bore 19', was interrupted, but a connection was made between the low pressure work spaces 22' and the feed bore 24 via the bore 21', the bypass groove 17', the bypass groove 34', the bypass groove 16' and the bore 23'.

Because of the change in the pressure application on the pressure intensifier piston 2, this piston now moves left and thus interrupts the connection of the feed bore 24 to the right front face of the control slider 3 via the outer one of the right neighboring control bore 28'. In order for the control slider 3 not to stop after running over half of its path, the connection via the inner one of the right neighboring control bores 28' remains. The inner one of the right neighboring control bores 28' remains covered by both the control groove 32 of the pressure intensifier piston 2 and the control groove 25' of the control slider 3 until the control slider 3 could reach the left end position and before the pressure intensifier piston 2 moving leftward closes again first the outer one and then the inner one of the two neighboring right control bores 28'.

The safe retention of the control slider 3 in its left end position up to the control reversal is effected by an area difference between inner higher and outer lower shoulder of the bypass groove 34' with different shoulder heights.

Intermediate positions exist during the motion of the pressure intensifier piston 2, where the pressure intensifier piston connects the two neighboring control bores 28, 28' on the one hand with the feed connected control bore 30 and also on the other hand with the discharge connected control bores 29, 29'. This does not occur however in the intermediate positions exactly at the same time, such that no change in control of the control slider 3 occurs.

A simultaneous release occurs only in the end positions such that on the one hand the full stroke of the pressure intensifier piston 2 and on the other hand the safe and assured controlled reversal in the end positions are assured.

The high pressure piston 5 also rests on the pressure piece 9 during the motion of the pressure intensifier piston 2 toward the left and is supported by the spring 37. The oil is pressed via the check valve 4 from the thus closed high pressure work spaces 35 into the high pressure work spaces 36.

The basic equation for considering the motions is

Force=Pressure times Area

F=P. A

F=Force p=Pressure

A=Area

Thus the pressure conversion or, respectively, intensification follows the next equation in case of a piston with different front faces:

$$P_1 \cdot A_1 = P_2 \cdot A_2$$

where the index 1 refers to the low pressure side, the index 2 refers to the high pressure side, $p_1$ is the low pressure, $A_1$ is the surface of the piston, which is adjacent to the low pressure area, $p_2$ is the high pressure, $A_2$ is the surface of the piston facing the high pressure. Since both a left as well as a right directed motion of the pressure intensifier piston 2 results in a pressure conversion, there is to be made a distinction between left and right.

Index L refers to left

Index R refers to right.

Thus the following equation holds for a leftward motion of a piston :

$$p_1 \cdot A_{1L} = p_{2L} \cdot A_{2L}$$

The low pressure p is the same for the two directions and thus needs not be distinguished. $A^{1L}$ and $A_{2L}$ is fixed by the construction employed.

Consequently, leftward motion of the piston results in a high pressure $$p_{2L} = p_1 \frac{A_{1L}}{A_{2L}}$$

The general surfaces A have to be determined for the instant pressure intensifier based on their hydraulic effectiveness. The associated pistons are given their own reference numerals in the drawings as follows:

Pressure intensifier piston 2

High pressure piston 5

High pressure piston 6

In order to avoid possible confusion relative to the indices 1 and 2 for the low pressure side and for the high pressure side, the following conventions are introduced:

pip 2=Pressure intensifier piston 2 hpp 5=high pressure piston 5 hpp 6=high pressure piston 6

While mostly the parts of the pressure intensifier are associated with their reference numeral, the following part of the description, which refers to explaining the invention by way of formulas, there are also introduced the further identifying indices set forth above. Thus reference is made in the following for example not to the pressure intensifier piston 2, but to the pressure intensifier piston pip2.

It holds for the pressure situation present that the low pressure $p_1$ is applied at the area $A_{1L}$ hydraulically active of the pressure intensifier piston pip2 (low pressure work spaces 22'). The low pressure $p_1$ effects a force $F_L$, which moves the pressure intensifier piston pip2 to the left. The same force $F_L$ slides the pressure intensifier piston pip2 over the left high pressure piston hpp5, whereby a high pressure $p_{2L}$ is generated in the high pressure work spaces 35 based on the hydraulically active area $A_{2L}$ and the oil passed with the high pressure $p_{2L}$ to the outside via the check valve 4.

$$p_1 \cdot A_{1L} = F_L = p_{2L} \cdot A_{2L}$$

$$p_{2L} = p_1 \frac{A_{1L}}{A_{2L}}$$

The hydraulically active area $A_{1L}$ in the low pressure work spaces 22' is the area of the pressure intensifier piston $A_{pip2}$ minus the area of the right high pressure piston $A_{hpp\,6}$ $$A_{1L} = A_{pip2} - A_{hpp6}$$

The hydraulically active area $A_{2L}$ in the high pressure work spaces 35 is the area of the left high pressure piston $A_{hpp5}$ minus the area of the right high pressure piston $A_{hpp6}$.

$$A_{2L} = A_{hpp5} - A_{hpp6}$$

If the ratio of the areas of the high pressure piston hpp5 to the high pressure piston hpp6 is selected to be about 2:1, then the following approximate equations result:

$$A_{hpp5}=2 \cdot A_{hpp6}$$

and $$A_{2L}=A_{hpp6}$$

A formula for the high pressure of the oil stream moved out on the left hand side during leftward motion of the pressure intensifier piston can be obtained:

$$p_{2L} = p_1 \frac{A_{hpp2} - A_{hpp6}}{A_{hpp6}}$$

Starting with the selection of the area ratio of the high pressure pistons 5, 6 and the same stroke based on the motion of the pressure intensifier piston 2, the stroke volume $V_1$ of the high pressure piston 5 as shown in FIG. 4 is twice the size of the stroke volume $V_2$ of the high pressure piston 6 as illustrated in FIG. 5. Thus only half on the oil stream coming from the high pressure work spaces 35 via the check valve 4 can be received by the high pressure work spaces 36. The other half of the high pressure oil stream is pressed via the discharge valve 13 to the high pressure connection 15 of the pressure intensifier.

If the pressure intensifier piston 2 passes into its left end position, then the control processes occur similar to those described above, only the longitudinal direction is reversed and the time is shifted. The pressure intensifier piston 2 moves again to the right, where the high pressure piston 5 lifts up off the pressure piece 9 and low pressure oil follows into the high pressure work spaces 35. The check valve 4 is closed . The stroke volume $V_2$ of the high pressure piston 6 (FIG. 5) is pressed from the high pressure work spaces 36 via the discharge valve 13 to the high pressure connection 15 of the pressure intensifier. Thus this is the same volume as upon leftward motion of the pressure intensifier piston 2.

It holds for the pressure situation during a right hand movement of the pressure intensifier piston pip2 that the low pressure $p_1$ is again applied at the hydraulically effective surface $A_{1R}$ (low pressure work spaces 22), which pressure effects a force $F_R$, which moves the pressure intensifier piston pip2 to the right. The pressure intensifier piston pip2 moves with the same force $f_R$ over the right high pressure piston hpp6, whereby a high pressure $p_{2R}$ is generated in the high pressure work spaces 36 by the hydraulically active surface $A_{2R}$, which moves the oil via the discharge valve 13 outwardly.

$$p_1 \cdot A_{1R} = F_R = p_{2R} \cdot A_{2R}$$

$$p_{2R} = p_1 \frac{A_{1R}}{A_{2R}}$$

The surface of the pressure intensifier piston $A_{pip2}$ is the hydraulically effective surface $A_{1R}$ in the low pressure work spaces 22.

$$A_{1R}=A_{pip2}$$

The hydraulically active area $A_{2R}$ in the high pressure work spaces 36 is the surface of the right high pressure piston $A_{hpp6}$.

$$A_{2R}=A_{hpp6}$$

The formula for the high pressure of the oil stream pushed out upon a right motion of the pressure intensifier piston thus reads:

$$p_{2R} = p_1 \frac{A_{pip2}}{A_{hpp6}}$$

It can be recognized that a difference exists between the high pressures $p_{2L}$ and $p_{2R}$ generated upon a left and right motion of the pressure intensifier piston pip2 ($p_{2L}$ and $p_{2R}$), which results in pressure variations on the high pressure side. These pressure variations can be neglected based on their magnitude in size and based on the operational frequency of the pressure intensifier or they can be minimized by a correction of the area ratio 2:1 of the high pressure pistons 5, 6.

Figure 6:
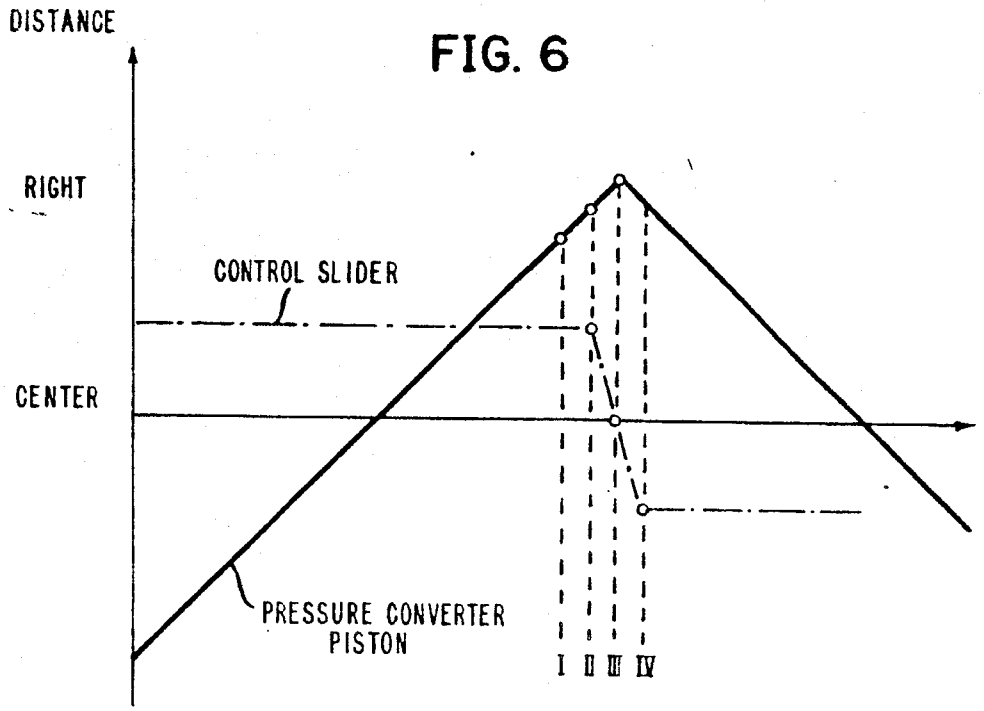
FIG. 6 is a time distance diagram for the motion of the pressure intensifier piston and of the control slider over about three quarters of a cycle, The definition of the shading located at the bottom of FIG. 5 refers to FIGS. 1, 4 and 5

FIG. 6 illustrates the course of motion of the pressure intensifier piston 2 and of the control slider 3.

According to the mode of operation described above it can be recognized that the control slide 3 remains in its right end position while the pressure intensifier piston 2 moves the left right. The point in time I corresponds to the representation according to FIG. 1. If the pressure intensifier piston 2 moves somewhat more to the right then a control oil stream is applied at the right hand side of the control slider 3 such that the control slider 3 starts at the point in time II to move leftward. The pressure intensifier piston 2 has reached its right terminal position at the point in time III, while the control slider 3 is approximately in the middle position. At this position the feed and the discharge change for the pressure intensifier piston 2, and also the pressure intensifier piston 2 moves leftward. The control slider 3 reaches at the point in time IV its left end position while the pressure intensifier piston 2 is still on its leftward movement. The control slider 3 remains in its left end position until as described above a reversal occurs, however now with reversed directions.

It will be understood that each of the elements described above, or two or more together, may also find a useful application in other types of pressure intensifier system configurations and fluid flow control procedures differing from the type described above.

While the invention has been illustrated and described as embodied in the context of a double acting and automatically reversing pressure intensifier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. Double acting and at the limit positions automatically reversing pressure intensifier comprising a case having a first bore hole and a second bore hole;

a pressure intensifier piston sliding in the first bore hole of the case, subdividing the first bore hole into two low pressure work spaces and furnished with two flat control grooves for passing control fluid at the outer circumference and with two pressure medium bore holes;

two high pressure pistons mounted to the case for sliding relative to and inside of the two pressure medium bore holes of the pressure intensifier piston;

a check valve disposed in the pressure intensifier piston and connecting the two pressure medium bore holes of the pressure intensifier piston;

a control slider disposed in the second bore hole of the case and furnished with two flat control grooves about at its middle region connected to respective front faces of the control slider via cross bore holes and axial bore holes in the control slider;

a wide bypass groove disposed on each of the two sides of the control slider;

a feed bore disposed in the case;

a discharge bore disposed in the case;

a pair of bypass grooves in the second bore hole each connected to the feed bore;

a pair of bypass grooves in the second bore hole each connected to the discharge bore; and a pair of bypass grooves each connected to a low pressure work volume of the first bore hole.

2. The double acting and at limiting positions automatically reversing pressure intensifier according to claim 1 wherein cross-sections of the high pressure pistons are about 2:1 for the piston on the input side to the piston on the high pressure output side.

3. The double acting and at limiting positions automatically reversing pressure intensifier according to claim 1 wherein the control slider is provided on each of its two end sides with a wide and deep bypass groove.

4. The double acting and at limiting positions automatically reversing pressure intensifier according to claim 1 wherein the control slider runs in parallel to the pressure intensifier piston and where the feed bore in the case is running in parallel to the control slider direction of motion for input of working fluid into the system and where the discharge bore in the case is running in parallel to the control slider direction of motion for discharging working fluid after use.

5. The double acting and at limiting positions automatically reversing pressure intensifier according to claim 1 wherein the control slider is provided on each of its two end sides with a wide and deep bypass groove; and wherein the control slider runs in parallel to the pressure intensifier piston and where the feed bore in the case is running in parallel to the control slider direction of motion for input of working fluid into the system and where the discharge bore in the case is running in parallel to the control slider direction of motion for discharging working fluid after use.

6. The double acting and at limiting positions automatically reversing pressure intensifier according to claim 1 further comprising a control bore connecting the middle of the first bore for the pressure intensifier piston to the feed bore;

two control bores, disposed at a distance from the control bore connecting to the feed bore, connecting the discharge bore to the first bore for the pressure intensifier piston; and where the pair of bypass grooves each connected to the discharge groove are disposed near the ends of the second bore, where the pair of bypass grooves each connected to the feed bore are disposed more toward the center of the second bore hole, and where the pair of bypass grooves each connected to a low pressure work volume are disposed in between the pair of bypass grooves each connected to the discharge bore and the pair of bypass grooves each connected to the feed bore.

7. The double acting and at limiting positions automatically reversing pressure intensifier according to claim 1 where the pair of bypass grooves each connected to the discharge groove are disposed near the ends of the second bore, where the pair of bypass grooves each connected to the feed bore are disposed more toward the center of the second bore hole, and where the pair of bypass grooves each connected to a low pressure work volume are disposed in between the pair of bypass grooves each connected to the discharge bore and the pair of bypass grooves each connected to the feed bore.

8. The double acting and at limiting positions automatically reversing pressure intensifier according to claim 1 further comprising a control bore connecting the middle of the first bore for the pressure intensifier piston to the feed bore;

two control bores, disposed at a distance from the control bore connecting to the feed bore, connecting the discharge bore to the first bore for the pressure intensifier piston.

9. The double acting and at limiting positions automatically reversing pressure intensifier according to claim 8 wherein a web is disposed between the two control grooves of the control slider and where the width of the web is dimensioned such that in the right (left) limit position of the control slider the right (left) inner control bore of the closely spaced control bores is covered by the web and, respectively, only the right (left) outer control bore of the closely spaced control bores is freely connected.

10. The double acting and at limiting positions automatically reversing pressure intensifier according to claim 8 further comprising two closely spaced control bores on each of the two sides relative to the middle connecting the bore of the pressure intensifier piston to the bore for the control slider.

11. The double acting and at limiting positions automatically reversing pressure intensifier according to claim 10 where the pressure intensifier piston is provided with flat control grooves of which the ones disposed toward the middle are wider than the outer control grooves and which control grooves are disposed such that in the limit position of the pressure intensifier piston on the right (left) side the outer left (right) flat control groove connects at least one of the two closely spaced left (right) control bore to the control bore on the left (right) side connected to the discharge bore, while the inner left (right) flat control groove connects the control bore connected to the feed bore to the two closely spaced right (left) control bores.

12. A double acting and at limiting positions automatically reversing pressure intensifier comprising a case having a first bore hole and a second bore hole;

a pressure intensifier piston sliding in the first bore hole of the case, subdividing the first bore hole into two low pressure work spaces and furnished with two flat control grooves for passing control fluid at the outer circumference and with two pressure medium bore holes;

two high pressure pistons solidly mounted to the case for sliding relative to and inside of the two pressure medium bore holes of the pressure intensifier piston a check valve disposed in the pressure intensifier piston and connecting the two pressure medium bore holes of the pressure intensifier piston;

a control slider disposed in the second bore hole of the case and furnished with two flat control grooves about at its middle region connected to respective front faces of the slider via cross bore holes and axial bore holes in the control slider;

a wide bypass groove disposed on each of the two sides of the control slider;

a feed bore disposed in the case;

a discharge bore disposed in the case;

a pair of bypass grooves in the second bore hole each connected to the feed bore;

a pair of bypass grooves in the second bore hole each connected to the discharge bore;

a pair of bypass grooves each connected to a low pressure work volume of the first bore hole; and two collars disposed at the ends of the control slider having a diameter smaller than the diameter of the middle piece resulting in that the outer shoulders of the bypass grooves of the control slider are more flat than the inner shoulders such that a force imbalance results after pressure being exerted in one of the bypass grooves of the control slider acting on the control slider to provide motion in the direction of the other bypass groove of the control slider.

13. The double acting and at limiting positions automatically reversing pressure intensifier according to claim 12 further comprising two bushings slid into the bore hole having cylindrical shape for the control slider for providing a sliding seal between the case and the outer collars of the control slider and having radial bores at a location corresponding to the bypass groove connected to the discharge bore and to the bypass groove connected to the first bore hole.

14. A double acting and at the limiting positions automatic reversing pressure intensifier comprising a case having a first and a second bore hole, a discharge bore and a feed bore;

a pressure intensifier piston sliding in the first bore hole;

a stationary piston engaging the pressure intensifier piston to generate a higher pressure in the fluid;

fluid channel means disposed at the pressure intensifier piston to provide two different flow connections corresponding to the two limiting positions of the pressure intensifier piston;

a control slider disposed in the second bore hole of the case;

two control bores, disposed at a distance from the control bore connecting to the feed bore, connecting the discharge bore to the first bore for the pressure intensifier piston;

hydraulic means connected to the fluid channel means disposed at the pressure intensifier piston to provide two different flow connections for moving the control slider from one limiting position into the opposite limiting position when the pressure intensifier reaches each of its limiting positions;

hydraulic valve means associated with the control slider to supply pressure fluid to move the pressure intensifier piston while the control slider is in a limiting position;

a control bore connecting the middle of the first bore for the pressure intensifier piston to the feed bore;

two control bores, disposed at a distance from the control bore connecting to the feed bore, connecting the discharge bore to the first bore for the pressure intensifier piston;

where the pressure intensifier piston is provided with flat control grooves of which the ones disposed toward the middle are wider than the outer control grooves and which control grooves are disposed such that in a limit position of the pressure intensifier piston on the right (left) side the outer left (right) flat control groove connects at least one of the two closely spaced left (right) control bore to the control bore on the left (right) side connected to the discharge bore, while the inner left (right) flat control groove connects the control bore connected to the feed bore to the two closely spaced right (left) control bores.

* * * * *